US009631643B2

(12) United States Patent
Hilzendegen

(10) Patent No.: US 9,631,643 B2
(45) Date of Patent: Apr. 25, 2017

(54) DEVICE TOGETHER WITH HYDRAULIC SYSTEM FOR ACTUATING LEAST ONE FIRST HYDRAULIC CONSUMER AND AT LEAST ONE SECOND HYDRAULIC CONSUMER

(71) Applicant: Hydac Fluidtechnik GmbH, Sulzbach/Saar (DE)

(72) Inventor: Philipp Hilzendegen, Wadern (DE)

(73) Assignee: HYDAC FLUIDTECHNIK GMBH, Sulzbach/Saar (DE)

( * ) Notice: Subject to any disclaimer, the term of this patent is extended or adjusted under 35 U.S.C. 154(b) by 272 days.

(21) Appl. No.: 13/261,952

(22) PCT Filed: Mar. 13, 2013

(86) PCT No.: PCT/EP2013/000734
§ 371 (c)(1),
(2) Date: Sep. 11, 2014

(87) PCT Pub. No.: WO2013/135375
PCT Pub. Date: Sep. 19, 2013

(65) Prior Publication Data

US 2015/0007714 A1 Jan. 8, 2015

(30) Foreign Application Priority Data

Mar. 14, 2012 (DE) ..... 10 2012 005 253

(51) Int. Cl.
*F15B 11/22* (2006.01)

(52) U.S. Cl.
CPC ..... *F15B 11/22* (2013.01); *F15B 2211/30505* (2013.01); *F15B 2211/40523* (2013.01); *F15B 2211/782* (2013.01)

(58) Field of Classification Search
CPC ..... F15B 11/22; F15B 2211/30505; F15B 2211/40523; F15B 2211/782
(Continued)

(56) References Cited

U.S. PATENT DOCUMENTS 5,473,828 A * 12/1995 Kishi ..... B66C 3/16 294/68.23
5,813,312 A * 9/1998 Arai ..... E02F 9/2242 60/422

(Continued)

FOREIGN PATENT DOCUMENTS

DE 1 222 376 8/1966
DE 1222376 B * 8/1966 ..... F15B 11/22

(Continued)

*Primary Examiner* — Thomas E Lazo
(74) *Attorney, Agent, or Firm* — Wenderoth, Lind & Ponack, L.L.P.

(57) ABSTRACT

Device with hydraulic system actuates first and second hydraulic consumers. The hydraulic consumers (10, 12) can be supplied with fluid at a predefinable pressure at least via a flow divider (26) for dividing a fluid flow from a pressure supply (P) into predefinable part flows leading to the respective hydraulic consumer (10, 12). A fluid flow from the hydraulic consumer (10) with higher pressure loading via the flow divider (26) to the hydraulic consumer (12) with lower pressure loading can be suppressed by one shut-off device (38) arranged between the flow divider (26) and at least one hydraulic consumer (12). The shut-off device (38) is arranged in a fluidic connection (F2) from the flow divider (26) to the hydraulic consumer (12) with lower pressure loading.

15 Claims, 3 Drawing Sheets

(58) Field of Classification Search
USPC ..... 60/422
See application file for complete search history.

(56) References Cited

U.S. PATENT DOCUMENTS

| | | | | |
|---|---|---|---|---|
| 6,189,432 | B1 * | 2/2001 | Colarelli | B66F 7/20 91/171 |
| 6,581,622 | B2 * | 6/2003 | Brand | F15B 11/22 137/98 |
| 7,553,120 | B2 * | 6/2009 | Veneziani | F15B 11/044 137/101 |
| 7,555,898 | B2 | 7/2009 | Wada | |

FOREIGN PATENT DOCUMENTS

| | | |
|---|---|---|
| DE | 23 56 414 A1 | 5/1975 |
| DE | 10 2004 039 898 A1 | 3/2005 |
| JP | 58-180898 | 12/1983 |

* cited by examiner

DEVICE TOGETHER WITH HYDRAULIC SYSTEM FOR ACTUATING LEAST ONE FIRST HYDRAULIC CONSUMER AND AT LEAST ONE SECOND HYDRAULIC CONSUMER

FIELD OF THE INVENTION

The invention relates to a device for actuating at least one first hydraulic consumer and at least one second hydraulic consumer. The invention further relates to a hydraulic system having such a device for actuating two hydraulic consumers.

BACKGROUND OF THE INVENTION

Such device is used, for example, in machines such as loaders for the movement of loads, and serves to actuate actuators having working cylinders, in which pistons are movably guided in accordance with a movement of the load that is to be moved. Depending on the positions of the pistons or actuators and the load moved thereby, an unfavorable shift in the balance point may lead to the tipping of the machine. To avoid tipping, these machines must meet the safety regulations laid out in the safety standard EN 15000, in particular. Accordingly, in the event of a risk of tipping, a movement that increases the load torque must be prevented, and a movement that reduces the load torque must be permitted. During the operation of the machine, a sudden shutdown of the consumers, in particular by intense braking decceleration may also cause a tipping of the machine. This problem has thus far been dealt with in that the allowable movement speed is reduced to reduce the braking decceleration. The movement speed is advantageously delayed proportional to the actuator position and to the load, or in other words, the movement is slowed. This slower movement is contrary to the user-side requirement of faster loading and unloading cycles. Alternatively, the movements of the two actuators can be permanently coupled in such a way that unwanted actuator positions are avoided.

In addition, uniform, "smooth" work are desirably made possible at the limits of the range of movement of the machine, or in other words, when the extreme positions of the actuators have been reached. For example, the flow divider, which is designed for a specific volume range, may be subject to leakage to such a degree that a fluid leakage flow is able to flow from one actuator that is allocated to a horizontal movement and that is subject to a higher pressure, to an actuator that is allocated to a vertical movement and that is subject to a lower pressure. The position of the additional actuator may be perceptibly influenced in the form of an irregularity in the in course of the movement, such as a "jolt". This situation occurs in particular when the horizontally movable actuator is fully retracted and the vertically movable actuator is fully extended. The known devices for actuating hydraulic consumers such as the actuators, do not reliably suppress fluid leakage flow in this situation.

A device for actuating at least two hydraulic consumers is known from U.S. Pat. No. 5,473,828. The consumers are designed as hydraulic working cylinders, each having piston rod drives that can be extended different distances out of the cylinder housings for the purpose of actuating identically formed bucket halves of an excavator. Due to the different distances traveled by the piston rod drives, the bucket mechanism can be raised and break loose the remaining soil foundation when the bucket mechanism is closed and has penetrated a soil mass. The closed excavator bucket is tipped in that the longer working cylinder performs such a tipping movement.

To be able to hold the bucket halves in the closed position during the tipping or breaking-loose movement, a control line is provided downstream of a flow divider. The flow divider supplies the two sides of the piston of the working cylinders with hydraulic fluid, behind the flow divider pathway, which supplies the working cylinder having the smaller extension length. The control line controls a 3/2 directional control valve in such a way that, as the pressure increases when breaking loose from the ground, this valve goes to its closed position so that an additional influx of working fluid to this hydraulic cylinder is stopped and so that this cylinder is held in its position that closes the bucket mechanism, without an overload.

A control system for a fluid pressure actuating drive for controlling an adjustment of a predetermined fluid pressure actuating drive of at least two fluid pressure actuating drives as hydraulic consumers is known from DE 11 2005 001 879 T5. The flow of pressurized fluid of those actuating drives is provided by a common fluid pressure source and can be individually distributed by a flow divider device. Within the context of this individual distribution, an independent shut-off device is allocated to each hydraulic consumer, which shut-off devices can be actuated by a central control device. Operating states at the respective hydraulic consumers are monitored by a comprehensive sensor system and cause the control device to supply quantities of fluid to the consumers by the respective shut-off device in the form of valves, or to discharge such fluid from these consumers, preferably into a tank. As a result of this separate actuation regarding the respective hydraulic consumer, this known solution allows performing a fine adjustment or, respectively, fine positioning of the hydraulic consumers, for example in the form of hydraulic actuators. Moreover, such opportunity is created to automatically adapt the position or location of a working tool, for example in the form of an excavator bucket, in accordance with the location of another movable element, for example in the form of a hydraulically actuated load lifting arm. This known solution is structurally complex and a reliable control of fluid leak flows in the above mentioned context is not possible with this known solution.

SUMMARY OF THE INVENTION

An object of the invention is to suppress a fluid leakage flow between two hydraulic consumers via a flow divider in a simple and reliable manner to allow supplying the consumers with fluid at different pressures.

This object is basically achieved according to the invention by a device as well as a hydraulic system comprising such device. The device is distinguished by a control line extending from the fluid connection, which extends from the hydraulic consumer having the respective higher pressure loading to the flow divider, to the shut-off device in such a way that the higher pressure loading actuates the shut-off device in the direction of the blocking position thereof. Regardless of the pressure situation of the actuated hydraulic consumer, a fluid pressure that exists in the fluid connection from the hydraulic consumer having a higher pressure loading to the flow divider does not reach the hydraulic consumer having a lower pressure loading, and consequently does not actuate this consumer in an unintended manner.

A fluid pressure that exists in the corresponding fluid connection at most reaches the shut-off device, which blocks a further fluid pathway to the respective other hydraulic consumer.

The at least one shut-off device, which is preferably designed as a valve, and especially preferably as a non-return valve, is advantageously actuated by the fluid pressure flowing through the flow divider, and can advantageously be blocked by the hydraulic consumer with the higher fluid pressure originating from the respective higher pressure loading during the operation of the device. In this advantageous embodiment of the invention, the at least one shut-off device is ensured to be blocked upon the occurrence of a fluid leakage flow at the flow divider. In an embodiment of the shut-off device as a non-return valve that can be blocked, this valve can advantageously be closed by the control line. The line for actuating the shut-off device is advantageously connected to the fluid connection from the hydraulic consumer having a higher pressure loading to the flow divider, such that that line conducts fluid.

In addition, fluid pressures can arise in both fluid directions between the hydraulic consumers, which are connected to one another via the flow divider. The consumers are subjected to higher and lower pressures in alternation. In so doing, two shut-off devices are advantageously provided. The shut-off devices are allocated to the respective fluid direction, and disposed in the fluid connection from the flow divider to the respective hydraulic consumer having a lower pressure loading. According to the invention, a shut-off device could be formed that is effective in both fluid directions and that suppresses corresponding fluid flows. With the help of the device according to the invention, the hydraulic consumer can be used in an unimpeded ("smooth") manner without disruptions from fluid flows even in special positions of the hydraulic consumer. The solution according to the invention can be implemented in an especially cost-effective manner. Leakage flows, which formerly ran via the flow divider when necessary, are thus reliably avoided.

To implement the above mentioned advantageous solutions, advantageously the control line extends between a connection point of the shut-off device, for the blocking thereof, and a branching point, into which both a fluid line coming from the outlet of a flow divider pathway of the flow divider is discharged, and the additional fluid line, which extends in the direction of the consumer having the higher pressure loading or, respectively, and which is connected to this consumer such that it conducts fluid.

The invention further relates to a hydraulic system comprising at least one first hydraulic consumer and at least one second hydraulic consumer, and a device according to the invention for actuating the hydraulic consumers. The device according to the invention may also be manufactured, sold and utilized in a hydraulic system as a tradable unit, independent of the hydraulic consumers and a pressure supply.

To use the hydraulic system in a machine for the movement of loads, the first and/or the second hydraulic consumer may be fluid-actuated actuators each having two actuator sides that are separated from one another. The actuator sides can be connected to the pressure supply for a movement of the respective actuator to guide fluid in an alternating manner. The actuator and the load connected thereto are moved according to the pressure loading of the respective actuator side. The actuators preferably each comprise a piston that can be extended and retracted in a working cylinder. The actuator sides that are allocated to a retracting movement of the respective piston are connected to the flow divider. However, actuator sides that are allocated to an extending movement of the respective piston can be connected to the flow divider. In this way, a synchronous run or, in other words, a coordinated movement of the two pistons or, respectively, actuators is ensured, either in the respective direction of retraction or in the respective direction of extension. Combinations of coupled retraction and extension movements are also conceivable.

In a further preferred embodiment of the hydraulic system according to the invention, one of the actuators comprises a telescopic cylinder having a piston that can be extended and retracted therein, preferably in a horizontal direction. An additional actuator comprises a lifting cylinder having a piston that can be extended and retracted therein, preferably in a vertical direction. The shut-off device is disposed between the flow divider and the lifting cylinder. In so doing, the total movement caused by the actuators is divided into a movement component, preferably in a horizontal direction, and an additional movement component, preferably in a vertical direction. The movements can be modified accordingly by the telescopic cylinder or, respectively, the lifting cylinder. By the arrangement according to the invention of the shut-off device between the flow divider and the lifting cylinder and a blocking of the corresponding fluid connection, a fluid leakage flow of approximately 5 l/min can be prevented from reaching the lifting cylinder during operation, for example in the case of a flow divider set up for 150 l/min and a pressure of 150 bar in the telescopic cylinder.

According to the invention, the above mentioned and additionally introduced features may be implemented individually or in any combination with one another.

Other objects, advantages and salient features of the present invention will become apparent from the following detailed description, which, taken in conjunction with the drawings, discloses a preferred embodiment of the present invention.

BRIEF DESCRIPTION OF THE DRAWINGS

Referring to the drawings that form a part of this disclosure are schematic and are not to scale.

DETAILED DESCRIPTION OF THE INVENTION

Figure 1:
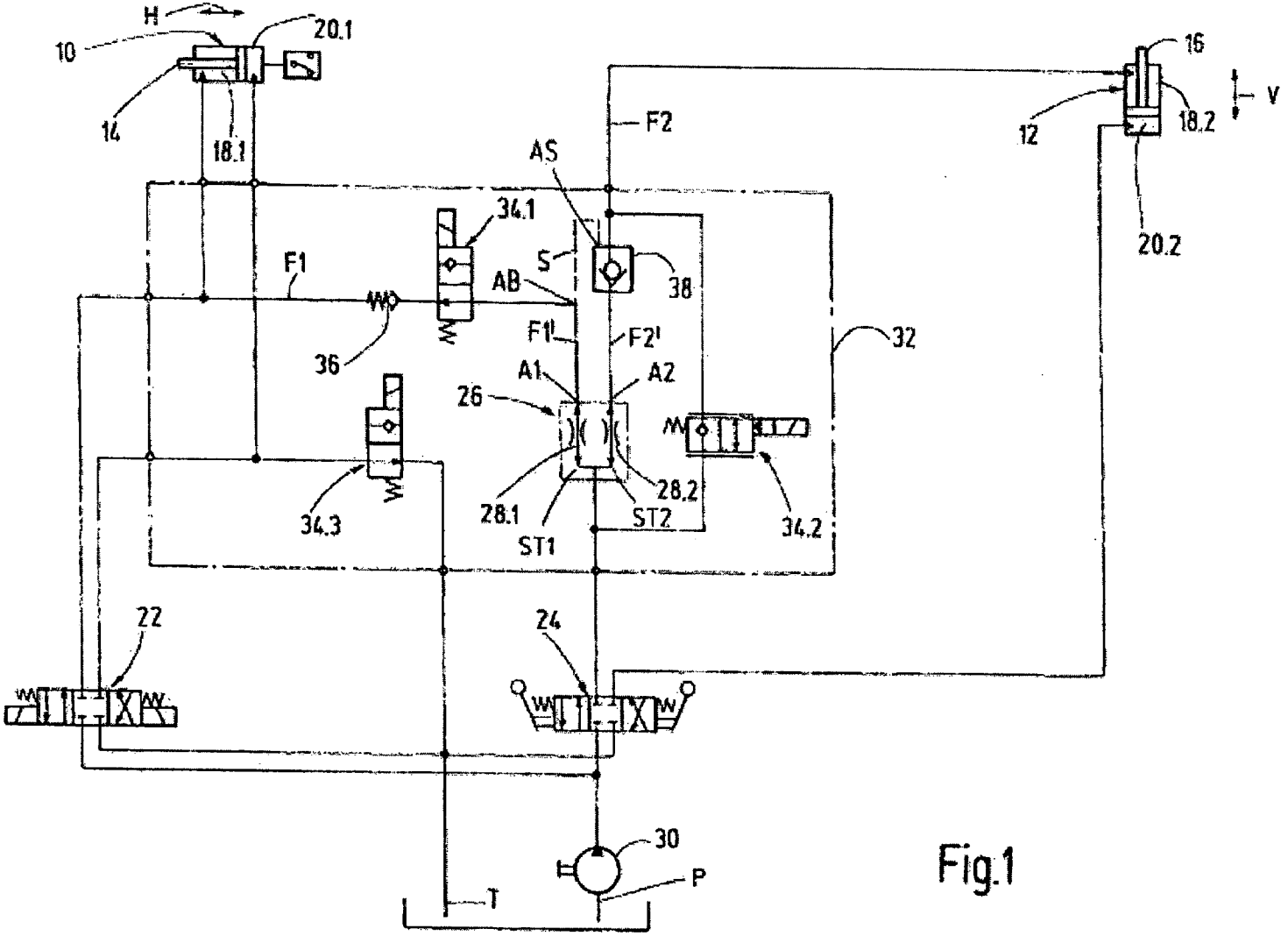
FIGS. 1 to 3 are each a circuit diagram of a hydraulic system equipped with a device according to an exemplary embodiment of the invention for actuating hydraulic consumers.
Figure 2:
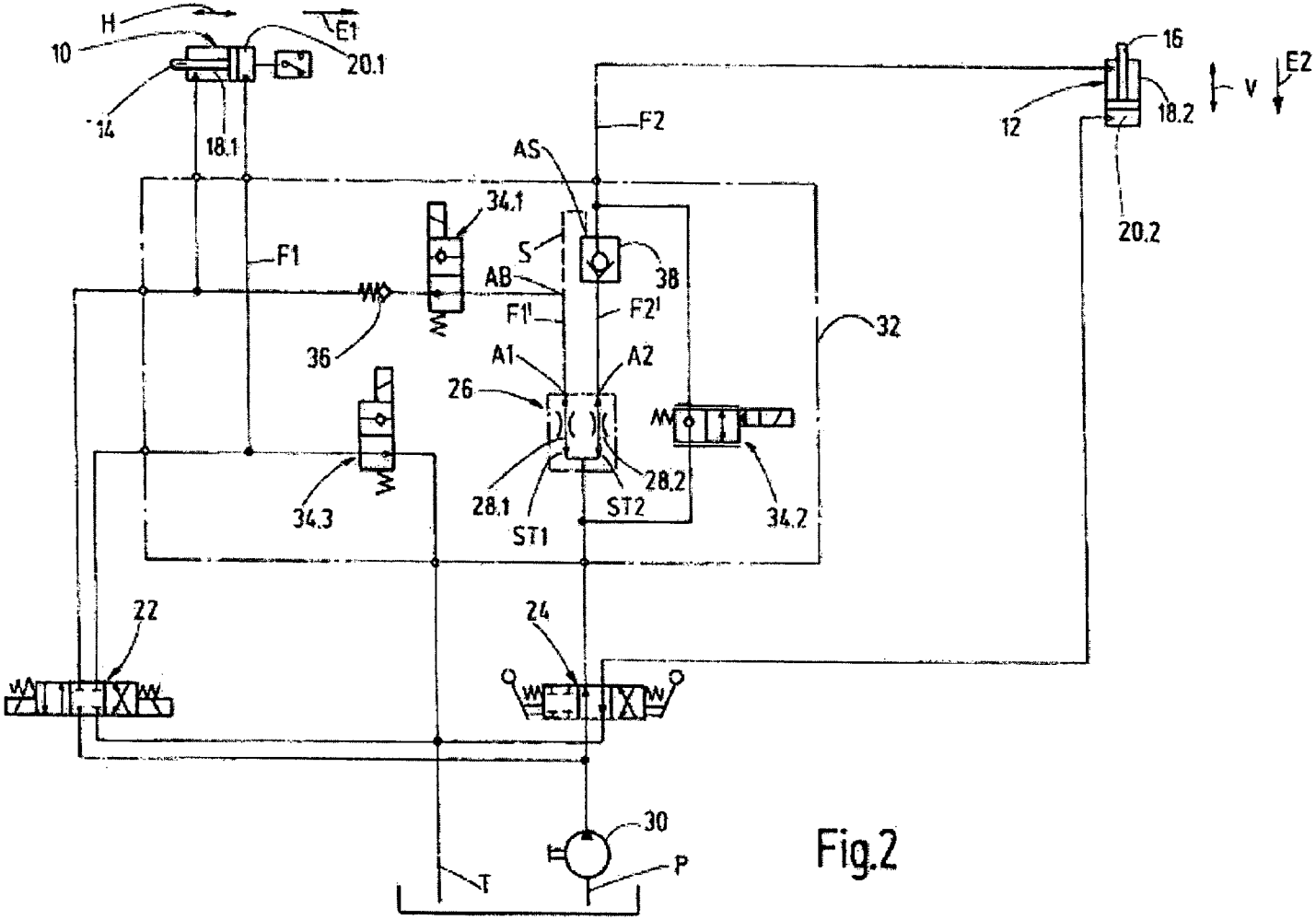
Figure 3:
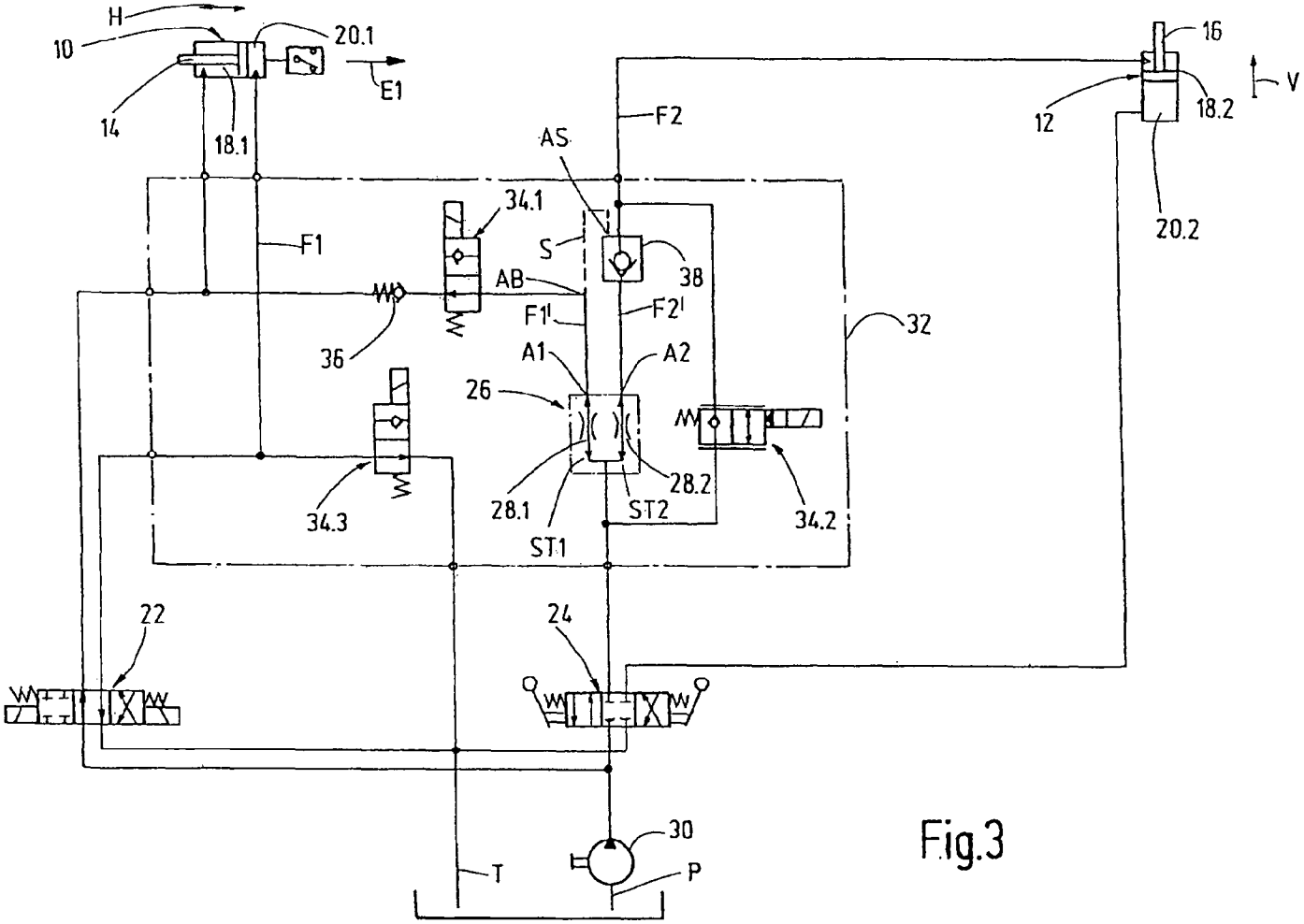

A hydraulic system shown in each of the FIGS. 1 to 3 comprises a first hydraulic consumer 10, which is designed as an actuator having a working cylinder, or more precisely, a telescopic cylinder, and a second hydraulic consumer 12, which is likewise designed as an actuator having a working cylinder, or more precisely, a lifting cylinder. In each of the two hydraulic consumers 10, 12, a first piston 14 or, respectively, a second piston 16 are guided in a displaceable manner. The first piston 14 can be extended and retracted in a horizontal direction H in the corresponding working cylinder. The second piston 16 can be extended and retracted in a vertical direction V in the corresponding working cylinder.

To adjust the position of the respective piston 14, 16 or, respectively, for a corresponding actuator movement, a retraction side 18.1, 18.2 or an extension side 20.1, 20.2 of the corresponding working cylinder is connected to a pressure supply P such that these conduct fluid, and fluid is supplied at a predefinable pressure. Fluid is moved from the pressure supply P to the retraction side 18.1, 18.2 or to the extension side 20.1, 20.2 of the respective hydraulic consumer 10, 12 by a pump 30 that can be actuated. Fluid that is displaced during a movement of the respective piston 14, 16 on the retraction side 18.1, 18.2 or on the extension side 20.1, 20.2 can be conveyed back into the tank or, respectively, a reservoir by a tank connection T. The superimposing of a lifting movement in a vertical direction V with a translational movement or, respectively, telescoping movement in the horizontal direction is possible with the hydraulic system shown in FIGS. 1 to 3.

A first valve 22 is designed as a 4/3 directional control valve that can be actuated electromagnetically. A second valve 24 is designed as a 4/3 directional control valve that can be actuated. Valves 22, 24 are provided for the respective desired supply of fluid to the hydraulic consumers 10, 12. The first valve 22 can switch between an ON position (left) for the pressure loading of the retraction side 18.1 of the first hydraulic consumer 10, a NEUTRAL position (middle) for closing off all fluid connections, and an OFF position (right) for the pressure loading of the extension side 20.1 of the first hydraulic consumer 10, and is connected directly between the pressure supply P and the first hydraulic consumer 10. The second valve 24 can switch between an ON position (left) for the pressure loading of a retraction side 18.2 of the second hydraulic consumer 12, a NEUTRAL position (middle) or closing off all fluid connections, and an OFF position (right) for the pressure loading an extension side 20.2 of the second hydraulic consumer 12, and can be connected between the pressure supply P and the two hydraulic consumers 10,12 such that the second valve 24 is connected directly to the extension side 20.2 of the second hydraulic consumer 12 and to both retraction sides 18.1, 18.2 of the two hydraulic consumers 10, 12.

To divide a fluid flow that is conveyed from the pressure supply P via the second valve 24 to the retraction sides 18.1, 18.2 of the hydraulic consumers 10, 12 into corresponding partial flows, a flow divider 26 is provided. The flow divider 26 has a first choke 28.1 and a second choke 28.2, which chokes divide the fluid flow coming from the pressure supply P, which is at 100%, into a first partial flow of 67% that runs to the first hydraulic consumer 10, for example, and into a second partial fluid flow of 33% running to the second hydraulic consumer 12, for example. Instead of this fixed, predetermined ratio between the first and second partial flow, the two chokes 28.1, 28.2 may also be designed to that they can be individually adjusted. The flow divider 26 is designed for a volume flow rate range of 150 l/min, for example. In so doing, a compromise must be found between the minimum volume flow rate range, in which the flow divider 26 fulfills its function, and a pressure drop via a second selector valve 34.2 at a maximum volume flow rate. In the case of a low volume flow rate of the fluid flow coming from the pressure supply P, the flow divider 26 functions according to the two chokes 28.1, 28.2.

A non-return valve 36 is provided in a first fluid connection or fluid line F1, from the flow divider 26 to the first hydraulic consumer 10. The non-return valve 36 closes in the case of a pressure supply to the retraction side 18.1 of the first hydraulic consumer 10 via the first valve 22, to avoid a pressure drop via the first fluid connection F1. A shut-off device 38 is provided in a second fluid connection or fluid line F2 from the flow divider 26 to the second hydraulic consumer 12. Shut-off device 38 is designed as a non-return or check valve and can be blocked via a control line S. Control line S is designed as a leakage flow line and is connected to the first fluid connection F1 such that it conducts fluid.

The fluid- and pressure conducting control line S (drawn with a dashed line) extends between a connection point AS of the shut-off device or check valve 38 for the blocking of the shut-off device 38, and a branching point AB, into which both a fluid line F1' coming from the outlet A 1 of a flow divider pathway ST1 of the flow divider 26 discharges. Also, the additional fluid line F1, which leads in the direction of the consumer 10, has the higher pressure loading. The flow divider pathway ST2 of the flow divider 26 is connected via the outlet A2 of the flow divider 26 to the fluid line F2', which further leads to an input connection of the shut-off device 38.

The connection point AS as well as the fluid line or connection F2 running to the consumer 12 are connected to the outlet side of the check valve 38. The blocking element of check valve 38 opens in the direction of the above mentioned outlet side upon obtaining a corresponding fluid pressure. Otherwise, taking into account the differential pressure between the inlet and outlet side of the stop valve 38, the check valve 38 can remain in a closed position.

The flow divider 26 and the shut-off device 38 are part of a device 32 for actuating the two hydraulic consumers 10, 12. The device 32 further comprises the non-return valve 36 and switchable valves 34.1, 34.2, 34.3. A first switchable valve 34.1 is disposed in the first fluid connection F1 from the flow divider 26 to the retraction side 18.1 of the first hydraulic consumer 10. A second switchable valve 34.2 is disposed on the retraction side 18.2 of the second hydraulic consumer 12 via the second valve 24 in order to bypass the flow divider 26 together and shut-off device 38 in the case of a direct pressure loading of the pressure supply P. A third switchable valve 34.3 is disposed in a direct return line from the extension side 20.1 of the first hydraulic consumer 10 to the tank connection T, i.e., parallel to the first valve 22.

FIG. 2 differs from FIG. 1 in that the second valve 24 shown in the right is in the ON position. Accordingly, via the flow divider 26, the retraction sides 18.1, 18.2 of the two hydraulic consumers 10, 12 are subjected to pressure and the respective pistons 14, 16 carry our a horizontal first retraction movement E1 or, respectively, a vertical second retraction movement E2. By the partial flows that are directed from the flow divider 26 through the fluid connections F1, F2 to the retraction side 18.1, 18.2 of the respective hydraulic consumer 10, 12, these consumers are permanently coupled, and the pistons 14, 16 move in accordance with the partial flows, which are more precisely adjusted in the flow divider 26 by the chokes 28.1, 28.2. In accordance with the partial volumes of the respective working cylinders, predefined on the respective retraction sides 18.1, 18.2 are in a predefined ratio to one another. In an application of the hydraulic system in a machine such as a telescopic handler for moving loads, the first piston 14 or, respectively, actuator passes through this permanent coupling during a lowering movement in accordance with the second retraction movement E2 of the second piston 16 or, respectively, actuator, in accordance with the first retraction movement E1. A tipping of the machine as a result of an unfavorable shift in the balance point is hereby effectively avoided. The fluid that is displaced by the movement of the pistons 14, 16 on the extension side 20.1, 20.2 of the respective hydraulic consumer 10, 12 is conveyed back into the tank by the tank connection T.

FIG. 3 differs from FIG. 1 in that the first valve 22 shown on the left is on the ON position. Accordingly, the retraction side 18.1 of the first hydraulic consumer 10 is subjected to pressure and the first piston 14 performs a retraction movement E1 toward the right in the drawing. Due to the NEUTRAL position of the second valve 24, the prevailing pressure on the retraction side 18.2 of the second piston 16 exists in the second fluid connection F2 and at the flow divider 26. In the situation shown in FIG. 3, the second piston 16 fully extended out of the working cylinder of the second hydraulic consumer 12, so that a lower pressure exists on the corresponding retraction side 18.2. This lower pressure likewise exists on the flow divider side at the non-return valve 36 in the first fluid connection F1. The above mentioned non-return valve 36 is closed due to the substantially higher pressure of the pressure supply P on the actuator side.

Fluid pressure that exists on the side of the flow divider 26 that is allocated to the first hydraulic consumer 10 or, respectively, in the corresponding section of the first fluid connection F1, can flow through the flow divider 26 nearly unhindered and without the shut-off device 38, would reach the retraction side 18.2 of the second hydraulic consumer 12 and could influence the position of the second piston 16 in an undesirable, in particular "jolting", manner. Such an undesired influence is prevented by the shut-off device 38 in such a way that the shut-off device 38 is actuated and closed by the fluid pressure that exists on the first fluid connection F1 via the control line S, before such a fluid flow reaches the second fluid connection F2 running to the second hydraulic consumer 12 via the flow divider 26.

As soon as the pressure that exists on the retraction side 18.1 of the first hydraulic consumer 10 is reduced and/or the switch position of the first valve 22 is modified, fluid leakage flows via the flow divider 26 are reduced and become negligible or are entirely prevented at the latest when there is a drop in pressure at the flow divider 26. As a result, the shut-off device 38 is unblocked again and the retraction side 18.2 of the second hydraulic consumer 12 can again be subjected to pressure by the position of the second valve 24 shown in FIG. 2. In the case of the embodiment of the device 32 according to the invention, in particular, a disruption-free functioning is allowed, even in specific situations of a hydraulic system, and thus to make rapid loading possible.

While one embodiment has been chosen to illustrate the invention, it will be understood by those skilled in the art that various changes and modifications can be made therein without departing from the scope of the invention as defined in the claims.

The invention claimed is:

1. A device for actuating first and second hydraulic consumers, the device comprising:

a flow divider dividing fluid flow from a pressure supply into predefinable first and second partial flows supplied to the first and second hydraulic consumers, respectively;

a shut-off device disposed between said flow divider and the second hydraulic consumer suppressing a fluid flow from the hydraulic consumer having a higher pressure loading via said flow divider to the hydraulic consumer having a lower pressure loading;

a fluid connection extending from said flow divider to the hydraulic consumer having the lower pressure loading, said shut-off device being disposed in said fluid connection;

a control line extending from a fluid connection extending between the hydraulic consumer having the higher pressure loading and said flow divider to said shut-off device such that the higher pressure loading actuates said shut-off device to a blocking position thereof and such that in a respective pressure situation of actuating one of the hydraulic consumers a fluid pressure in a fluid connection from the hydraulic consumer having the higher pressure loading to said flow divider does not reach the hydraulic consumer having the lower pressure loading and consequently not actuating the hydraulic consumer having the lower pressure loading in an unintended manner; and first and second valves being connected to and supplying fluid to the first and second hydraulic consumers, respectively, said second valve being connected between a pressure supply and the first and second hydraulic consumers and being connected directly to an extension side of the second hydraulic consumer and to retraction sides of the first and second hydraulic consumers.

2. A device according to claim 1 wherein said shut-off device is actuatable by fluid pressure flowing through said flow divider and is blockable by fluid pressure originating from the hydraulic consumer having the higher pressure loading during operation.

3. A device according to claim 2 wherein said shut-off device is a non-return valve.

4. A device according to claim 1 wherein said control line extends between a connection point of said shut-off device for blocking said connection point and a branching point connecting a fluid line from an outlet of a divider pathway of said flow divider and to a fluid line extending in a direction of the hydraulic consumer with the higher pressure loading.

5. A hydraulic system, comprising first and second hydraulic consumers, each of said hydraulic consumers having an extension side and a retraction side;

a pressure supply;

a flow divider dividing fluid flow into higher and lower partial flows supplied to said first and second hydraulic consumers, respectively;

a shut-off device disposed between said flow divider and said second hydraulic consumer suppressing a fluid flow from said first hydraulic consumer to said second hydraulic consumer via said flow divider;

a first fluid connection extending between said first hydraulic consumer and said flow divider;

a second fluid connection extending from said flow divider to said second hydraulic consumer, said shut-off device being disposed in said second fluid connection;

a control line extending from said first fluid connection to said shut-off device such that higher pressure loading of said first hydraulic consumer actuates said shut-off device to a blocking position thereof and such that in a respective actuating of said first hydraulic consumer fluid pressure in said first fluid connection does not reach said second hydraulic consumer and does not actuate said second hydraulic consumer in an unintended manner; and first and second valves connected to said pressure supply and said first and second hydraulic consumers, respectively, said second valve being connected directly to said extension side of said second hydraulic consumer and to said retraction sides of said first and second hydraulic consumers.

6. A hydraulic system according to claim 5 wherein each of said first and second hydraulic consumers comprises a fluid actuator having said extension and retraction sides thereof separated from one another by a piston and connected to said pressure supply to move said piston and to guide fluid in an alternating manner to said extension and retraction sides thereof.

7. A hydraulic system according to claim 6 wherein each said piston being guided in a working cylinder of the respective hydraulic consumer between extended and retracted positions, said retraction sides of said first and second hydraulic consumers being connected to said flow divider.

8. A hydraulic system according to claim 6 wherein said piston of said first hydraulic consumer is extendable and retractable in a telescopic cylinder in a horizontal direction; and said piston of said second hydraulic consumer is extendable and retractable in a lifting cylinder in a vertical direction, said shut-off device being between said flow divider and said lifting cylinder.

9. A hydraulic system according to claim 5 wherein said shut-off device is actuatable by fluid pressure flowing through said flow divider and is blockable by fluid pressure originating from said first hydraulic consumer.

10. A hydraulic consumer according to claim 9 wherein said shut-off device is a non-return valve.

11. A hydraulic consumer according to claim 5 wherein said control line extends between a connection point of said shut-off device for blocking said connection point and a branching point connecting a fluid line from an outlet of a divider pathway of said flow divider and said first fluid line.

12. A device for actuating first and second hydraulic consumers with each of said hydraulic consumers having an extension side and a retraction side via a pressure supply, the device comprising:

a flow divider dividing fluid flow into higher and lower partial flows supplied to the first and second hydraulic consumers, respectively;

a shut-off device disposed between said flow divider and the second hydraulic consumer suppressing a fluid flow from the first hydraulic consumer to the second hydraulic consumer via said flow divider;

a first fluid connection extending between the first hydraulic consumer and said flow divider;

a second fluid connection extending from said flow divider to the second hydraulic consumer, said shut-off device being disposed in said second fluid connection;

a control line extending from said first fluid connection to said shut-off device such that higher pressure loading of the first hydraulic consumer actuates said shut-off device to a blocking position thereof and such that in a respective actuating of the first hydraulic consumer fluid pressure in said first fluid connection does not reach the second hydraulic consumer and does not actuate the second hydraulic consumer in an unintended manner; and first and second valves connecting to the pressure supply to the first and second hydraulic consumers, respectively, said second valve being connected directly to the extension side of the second hydraulic consumer and to the retraction sides of the first and second hydraulic consumers.

13. A device according to claim 12 wherein said shut-off device is actuatable by fluid pressure flowing through said flow divider and is blockable by fluid pressure originating from the first hydraulic consumer.

14. A device according to claim 13 wherein said shut-off device is a non-return valve.

15. A device according to claim 12 wherein said control line extends between a connection point of said shut-off device for blocking said connection point and a branching point connecting a fluid line from an outlet of a divider pathway of said flow divider and to the first fluid connection.

* * * * *